US006446458B1

(12) United States Patent
Klepach

(10) Patent No.: US 6,446,458 B1
(45) Date of Patent: Sep. 10, 2002

(54) BEVERAGE DISPENSING SYSTEM

(75) Inventor: Harry Klepach, Palm Dale, CA (US)

(73) Assignee: Micro Matic USA, Inc., Northridge, CA (US)

( * ) Notice: Subject to any disclaimer, the term of this patent is extended or adjusted under 35 U.S.C. 154(b) by 0 days.

(21) Appl. No.: 09/917,547

(22) Filed: Jul. 27, 2001

(51) Int. Cl.[7] ..... B67D 5/62; F25D 19/00
(52) U.S. Cl. ..... 62/394; 62/298
(58) Field of Search ..... 62/389, 393, 394, 62/298; 222/146.6

(56) References Cited

U.S. PATENT DOCUMENTS 2,162,842 A * 6/1939 Dolison et al. ..... 225/1
2,331,834 A * 10/1943 Harr ..... 225/3
2,638,758 A * 5/1953 Daun ..... 62/141
4,674,296 A 6/1987 Renaud
5,279,446 A * 1/1994 Cook et al. ..... 222/54
6,341,500 B1 * 1/2002 Paxman ..... 62/389

* cited by examiner

*Primary Examiner*—Denise L. Esquivel
*Assistant Examiner*—Melvin Jones
(74) *Attorney, Agent, or Firm*—James E. Brunton

(57) ABSTRACT

A beverage system for dispensing a beverage from a beverage container that includes a unique cooling assemblage for cooling the beverage so that as the beverage leave the dispensing faucet it is appropriately chilled. The cooling assemblage comprises a uniquely configured cooling component that is interposed between the beverage container and the dispensing faucet and can be interconnected with a refrigeration line.

11 Claims, 6 Drawing Sheets

BEVERAGE DISPENSING SYSTEM

BACKGROUND OF THE INVENTION

1. Field of the Invention

The present invention relates generally to beverage dispensing systems of the type having a dispensing faucet, a beverage container remote from the faucet and a feed line interconnecting the faucet with the beverage container to permit beverage to flow from the container to the faucet. More particularly, the invention concerns a beverage dispensing system of the character described that includes a novel cooling component that can be connected to the feed line and to a refrigeration line for cooling the feed line so as to ensure that the beverage leaving the faucet is appropriately chilled.

2. Discussion of the Prior Art

The proper dispensing of many beverages requires that the beverage be at a proper temperature when it leaves the dispensing faucet. This is particularly true in the dispensing of beer because, when warm draft beer is drawn into a glass, excessive foam is generated. Accordingly, unless considerable time is spent in the dispensing process, incomplete filling of the glasses results. In active beer parlors this time is simply not available. Because of this problem several methods have been suggested for reducing foam generation by cooling the draft beer in the feed line between the faucet and the beer barrel or keg.

In the past, cooling of the feed line was typically accomplished by a refrigeration line charged with a suitable refrigeration fluid that was placed in proximity with the feed line. Although this method resulted in improved cooling it was not entirely satisfactory.

Accordingly, an improved apparatus was suggested to better cool the feed line leading to the dispensing faucet. This apparatus, which is described in U.S. Pat. No. 4,674,296 issued to Renaud, includes a temperature conductive block that is disposed proximate the feed line and includes a channel adapted to receive the refrigeration line. With this construction, the block is cooled by the refrigeration line which, in turn, cools the feed line. During the beverage dispensing operation, the beer or other liquid before exiting the faucet passes through a cooled zone formed by the conductive block and is at least partially cooled thereby.

The apparatus of the present invention comprises an improvement over all of the prior art cooling approaches and, because of its unique construction, functions to more effectively and reliably cool the beverage flowing from the dispensing faucet. More particularly, in the apparatus of the present invention, a uniquely configured cooling component is disposed in contact with both the product line carrying the beverage and with the shank to which the dispensing faucet is connected so that the beverage is continuously cooled until the time it exits the dispensing faucet.

SUMMARY OF THE INVENTION

It is an object of the present invention to provide a beverage dispensing system for dispensing a beverage from a beverage container that includes a unique cooling means for cooling the beverage so that as the beverage leaves the dispensing faucet it is appropriately chilled. More particularly, it is an object of the invention to provide a beverage dispensing system of the aforementioned character in which the cooling means comprises a uniquely configured cooling component that is interposed between the beverage container and the dispensing faucet so as to effectively cool the beverage flowing toward the dispensing faucet.

Another object of the invention is to provide a dispensing system of the character described in the preceding paragraph in which the cooling component can be quickly and easily interconnected with a refrigeration line that carries a refrigerant such as glycol.

Another object of the invention is to provide a dispensing system of the type described, in which the cooling component surrounds and is interconnected with the connector shank of the dispensing system to which the dispensing faucet is connected.

Another object of the invention is to provide a dispensing system of the character described in the preceding paragraph, in which the cooling component surrounds and is interconnected with a connector tube that is, in turn, connected to the beverage line that carries the beverage from the beverage container to the dispensing system.

Another object of the invention is to provide a novel dispensing system that includes a uniquely configured cooling component that is provided with an antirotation head that lockably engages the draft tower and prevents rotation of the cooling component and the connector tube during interconnection of the dispensing faucet with the cooling component.

Another object of the attention is to provide a dispensing system character described in the preceding paragraphs that is of a simple construction and one that can be inexpensively manufactured and easily installed within a conventional draft tower of a beer dispensing system.

These and other objects of the invention are achieved by the novel apparatus of the invention, the details of construction are more fully described in the paragraphs that follow.

DESCRIPTION OF THE INVENTION

Figure 1:
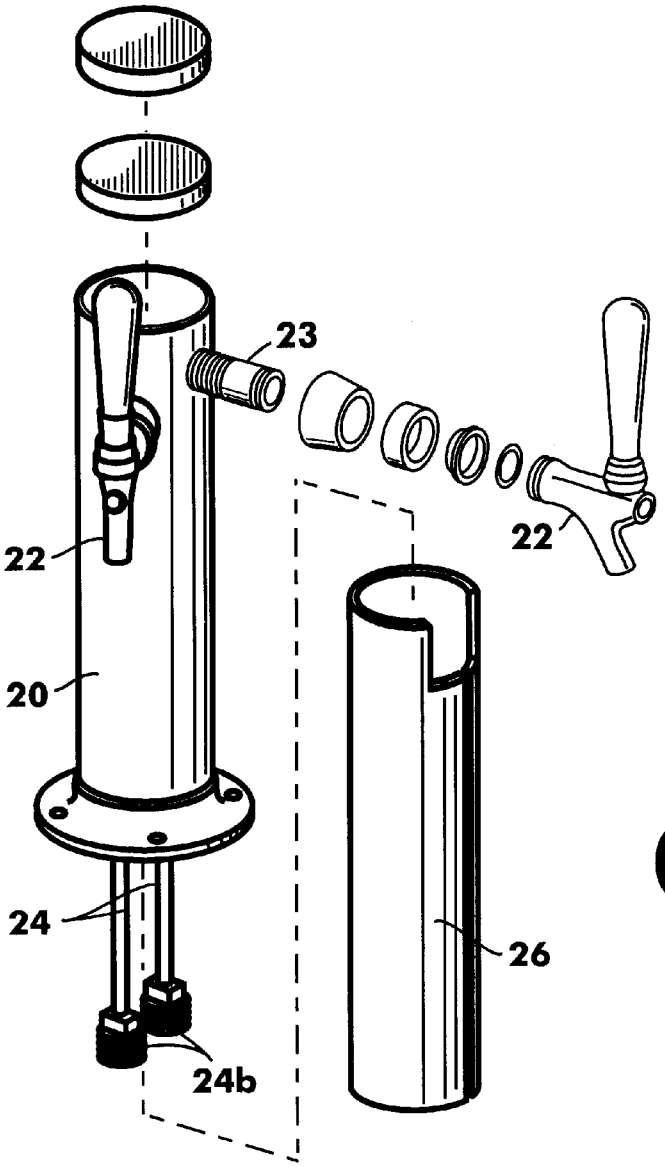
Fig. 1 (Prior Art)
FIG. 1 is a generally perspective, exploded view of a portion of a conventional prior art dispensing system that is of a character with which the apparatus of the invention can be used.
Figure 2:
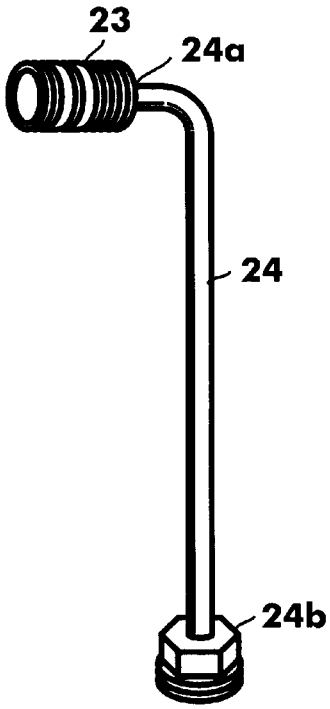
Fig. 2 (Prior Art)
FIG. 2 is a generally perspective view of a prior art product tube which functions to carry the beverage, such a beer, from the keg to the dispensing faucet.

Referring to drawings and particularly to FIGS. 1 and 2, one form of prior art beverage dispensing system is there shown. This system includes a conventional draft tower 20 to which a pair of dispensing faucets 22 can be removably connected by means of threaded connector members 23. Disposed within draft tower 20 is a prior art connector tube 24 having a first end 24*a* and a second end 24*b*. End 24*a* of the connector tube is interconnected with a selected one of the dispensing faucets 22 by means of a threaded connector 23; while end 24*b* is interconnected with a feed line that carries the beverage from a remotely located container to end 24*b* of the connector tube. In a typical beer dispensing establishment, draft tower 22 is generally bolted to the top of a bar or a like flat surface.

In the prior art construction shown in FIGS. 1 and 2, the beverage flowing through the connector tube 24 is typically cooled by a refrigeration line (not shown) that extends within the interior of draft tower 20. To assist in maintaining the interior of the draft tower in an appropriately cooled condition, an insulation sleeve 26, which may be of the character shown in FIG. 1, is disposed within draft tower 20.

Figure 3:
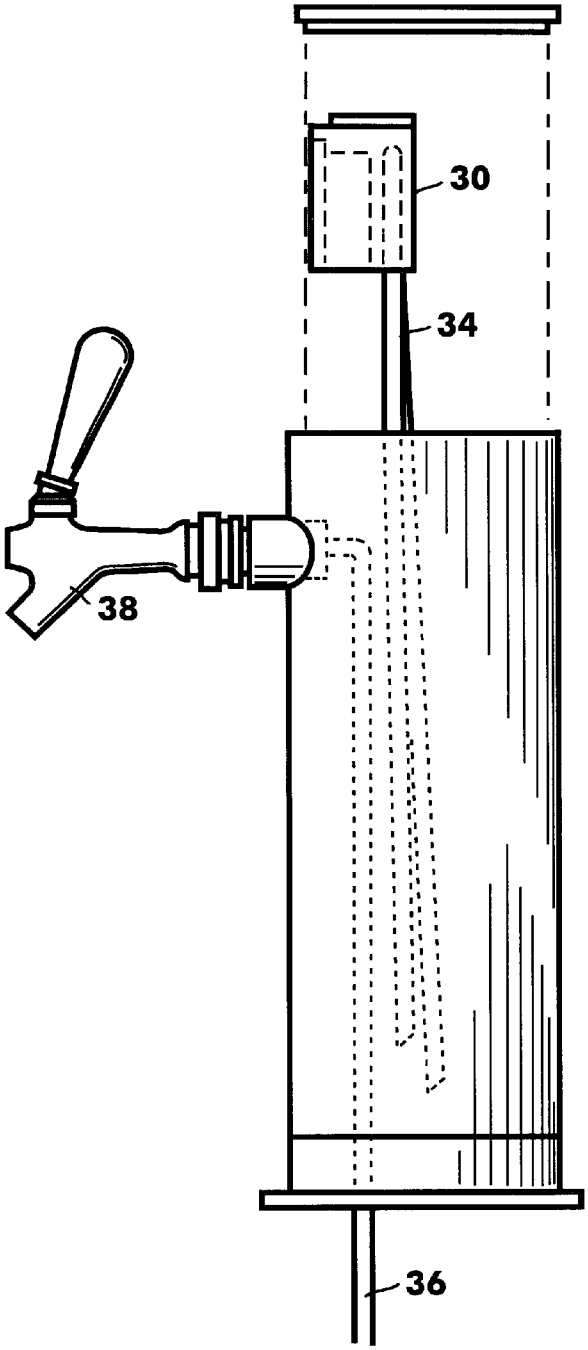
Fig. 3 (Prior Art)
FIG. 3 is a side-elevational, exploded view of one form of a prior art beverage cooling apparatus that is adapted to be installed within a draft tower of a beer dispensing system to which a conventional dispensing faucet is interconnected.
Figure 4:
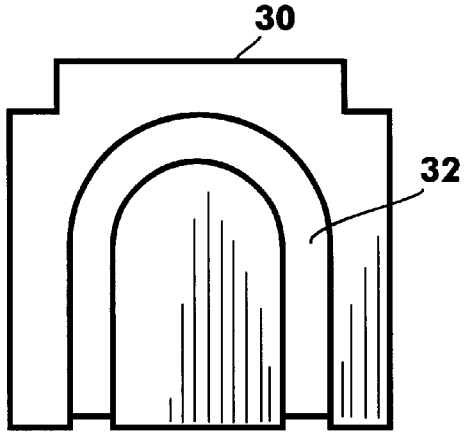
Fig. 4 (Prior Art)
FIG. 4 is a greatly enlarged front view of the refrigeration block of the prior art apparatus shown in FIG. 3. The refrigeration block shown in FIG. 4 is more clearly illustrated and described in U.S. Pat. No. 4,674,296 issued to Renaud.

As previously mentioned, the prior art system shown in FIGS. 1 and 2, when operated in certain environments, fails to cool a beverage such as beer sufficiently to prevent unwanted foaming during the beverage dispensing operation. To improve upon this condition, the prior art system shown in FIGS. 3 and 4 was suggested. This system, which is illustrated and described in U.S. Pat. No. 4,674,296 issued to Renaud, includes a cold block 30 provided with a channel 32 (FIG. 4) that is adapted to receive a portion of a refrigeration line 34 (FIG. 3). In this way, the cold block 30 is cooled by the refrigeration line 34 which in turn cools the beverage feed line 36 (FIG. 3). As shown in FIG. 3, beverage feed line 36 is interconnected at its upper end with a beverage dispensing faucet 38.

Figure 6:
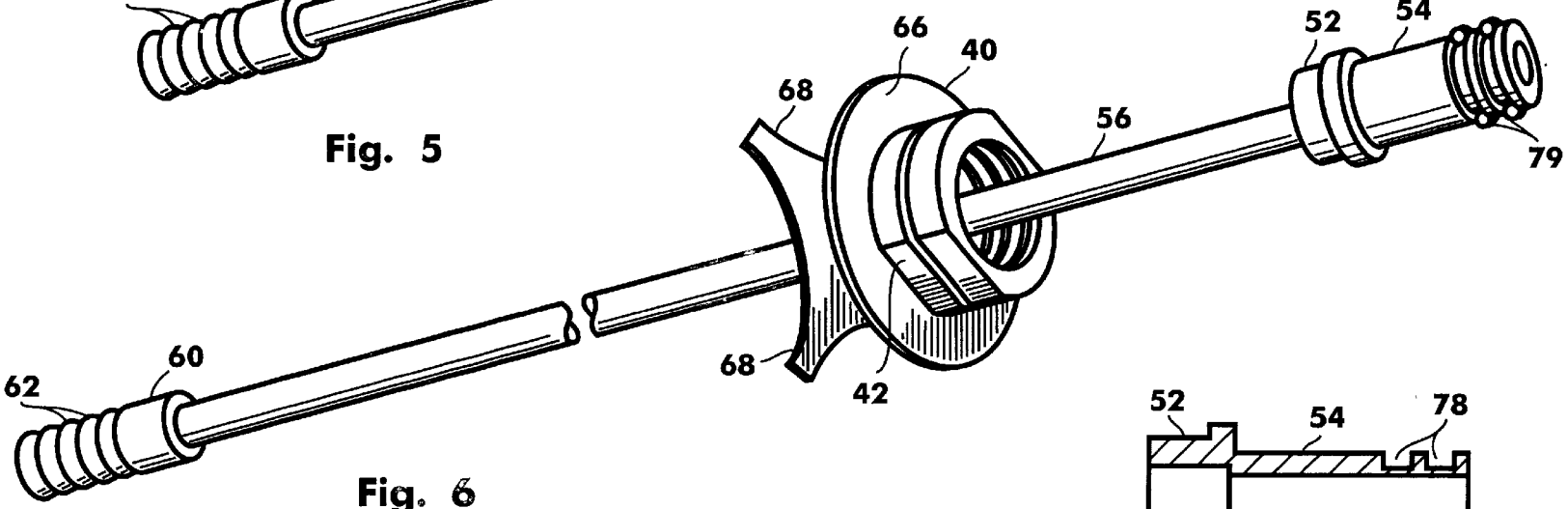
FIG. 6 is a generally perspective view similar to FIG. 5, but showing the connector tube assembly in the process of being interconnected with the cooling component.
Figure 7:
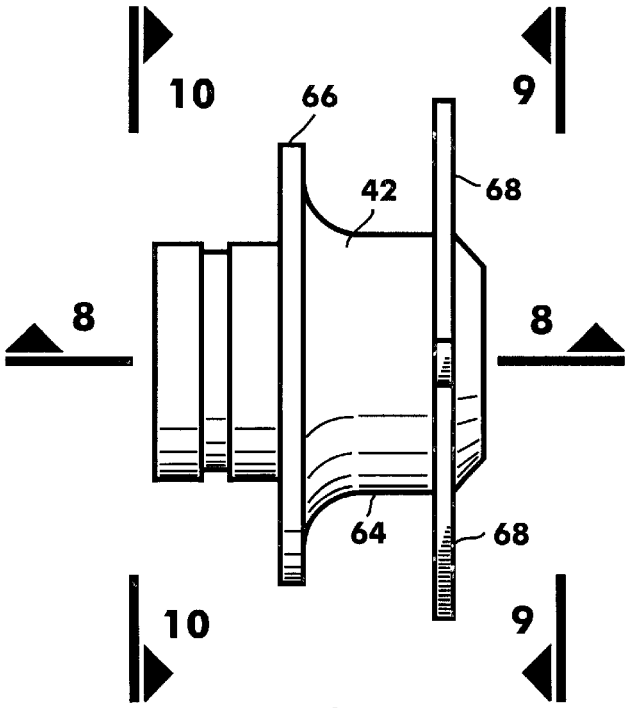
FIG. 7 is an enlarged, side-elevational view of the cooling component of the assembly shown in FIGS. 5 and 6.
Figure 8:
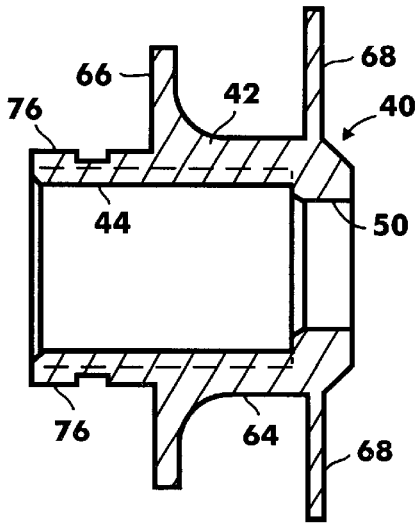
FIG. 8 is a cross-sectional view taken along lines 8—8 of FIG. 7.
Figure 9:
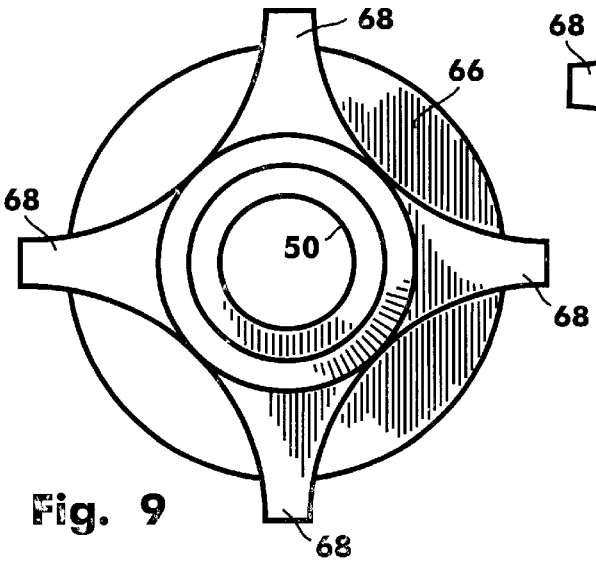
FIG. 9 is a view taken along lines 9—9 of FIG. 7.
Figure 12:
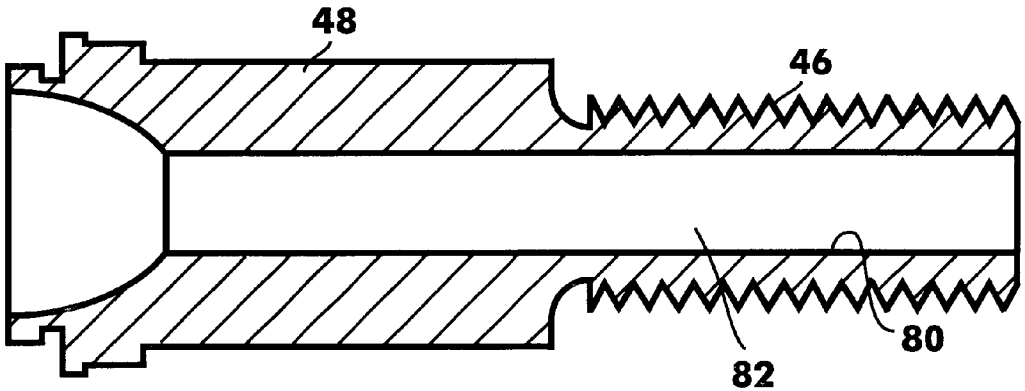
FIG. 12 is a cross-sectional view taken along lines 12—12 of FIG. 11.

Referring next to FIGS. 5 through 12, a portion of one form of the apparatus of the present invention is there shown. This apparatus comprises a significant improvement over the prior art system shown in FIGS. 1 through 4 and includes a uniquely configured cooling component, generally designated in the drawings by the numeral 40. Cooling component 40 is preferably formed from a heat conductive metal such as brass includes a central body portion 42 (FIG. 8). Central body portion 42 is provided with a first threaded bore 44 that threadably receives the connector shank 46 of the faucet connector means which here has the general configuration shown in FIGS. 11 and 12. As will presently be described, the faucet connector means functions to removably interconnect the faucet assembly of the dispensing system with a draft tower such as that illustrated in FIG. 1 of the drawings. As best seen in FIG. 12, the faucet connector means of the present form of the invention includes a body portion 48 to which a conventional dispensing faucet can be interconnected in the manner well understood by those skilled in the art.

As best seen in FIG. 8, cooling component 40 also includes a second reduced diameter bore 50 that is coaxially aligned with threaded bore 44 in the manner best seen in FIG. 8. Bore 50 is strategically sized so as to closely receive the collar portion 52 of a connector probe 54 that is interconnected with an elongated connector tube 56 in the manner best seen in FIG. 6 of the drawings. More particularly, illustrated in FIG. 6A of the drawings, connector probe 54 is provided with an axially bore 57 that closely receives the upper extremity of the connector tube 56. Connector tube 56 can be fixedly interconnected with connector probe 54 by any suitable means such as welding. Disposed proximate the lower extremity of connector tube 56 is a feed line connector means for connecting connector tube 56 to a feed line leading to a remotely located beverage container such as a beer keg. This feed line connector means is here provided in the form of a generally cylindrically shaped connector 60 that includes a plurality of longitudinally spaced apart, circumferentially extending tube gripping protuberances 62.

Figure 5:
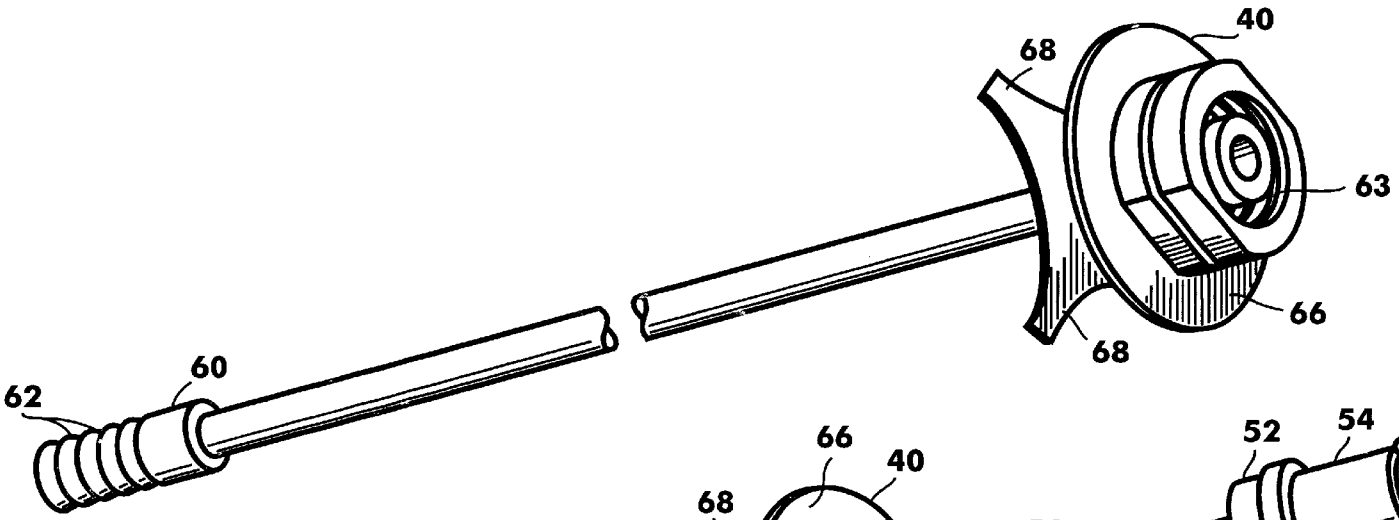
FIG. 5 is a generally perspective view of one form of the cooling component of the present invention shown interconnected with a connector tube assembly that is adapted to be interconnected with the beverage feed line.

After connector probe 54 is suitably interconnected with connector tube 56 in the manner shown in FIG. 6, the connector portion or collar 52 of the connector probe can be press fit into second bore 50 of cooling component 40 to provide the subassembly construction shown in FIG. 5 wherein the body portion 54 of the connector probe extends into internally threaded bore 44 to form an annular shaped opening 62 of the character best seen in FIG. 5. As will later be discussed, connector shank 46 of the faucet connector means is received within annular space 62 at the time of interconnection of the dispensing faucet with the assemblage shown in FIG. 5.

Figure 13:
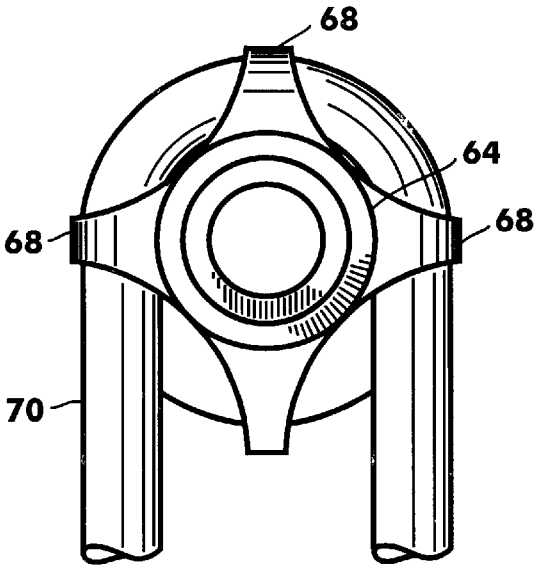
FIG. 13 is a front view of the cooling component of the apparatus of the invention showing the cooling tube through which the refrigerant flows coiled about the cooling component.
Figure 15:
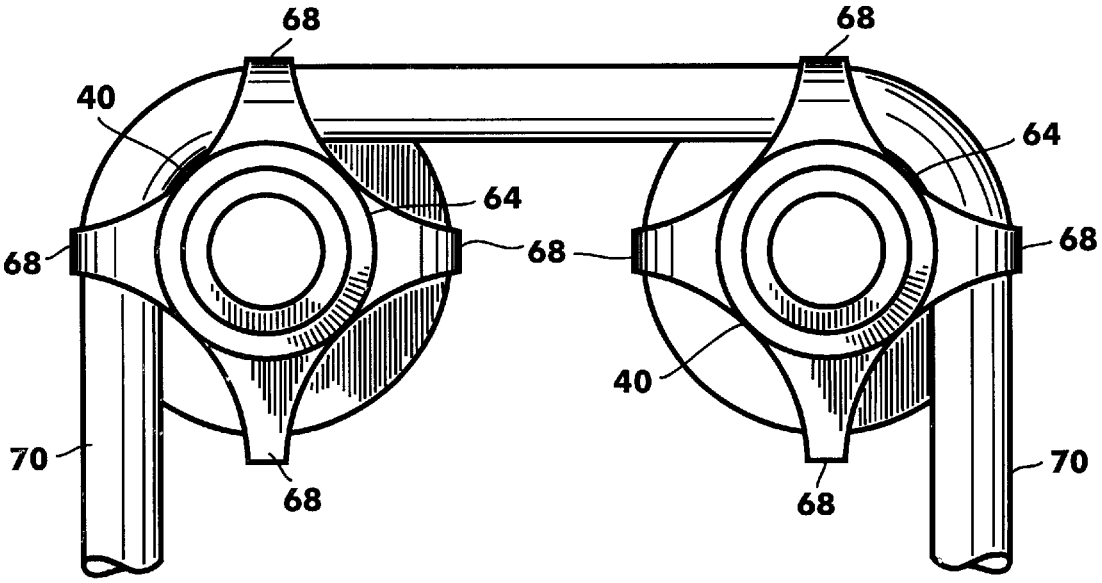
FIG. 15 is a front view of a pair of cooling components of the apparatus of an alternate form of the invention showing the cooling tube through which the refrigerant flows coiled about the two cooling components.

An important feature of the cooling component 40 of the present form of the invention resides in the provision of a cooling tube receiving groove 64 that circumscribes internally threaded bore 44 in the manner shown in FIGS. 7 and 8. Groove 64 is bounded by a radially, outwardly extending flange 66 and a plurality of circumferentially spaced, radially outwardly extending locking fingers 68 which function to securely grip the refrigeration line of the dispensing system. As illustrated in FIG. 13 and 15, groove 64 closely receives a portion of the refrigeration tube which is generally identified in FIGS. 13 and 15 by the numeral 70. When a single cooling component 40 is used, the refrigeration tube 70 is curved around the cooling component in the manner shown in FIG. 13 and ears 68 are bend around the tube in the manner shown in FIG. 13 to securely hold the refrigeration tube in place within groove 64. When two cooling components are used in the manner shown in FIG. 15, the refrigeration tube is formed about both cooling components in the manner shown in FIG. 15 and ears 68 are bent over the tubing to once again hold it in place within the grooves formed in the cooling components.

Figure 10:
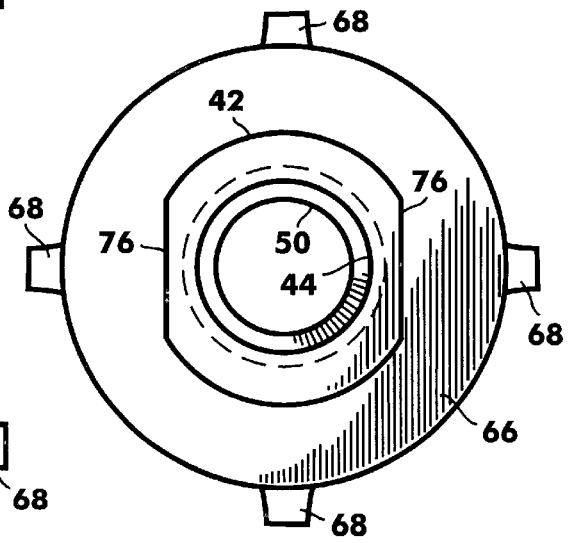
FIG. 10 is a view taken along lines 10—10 of FIG. 7.
Figure 11:
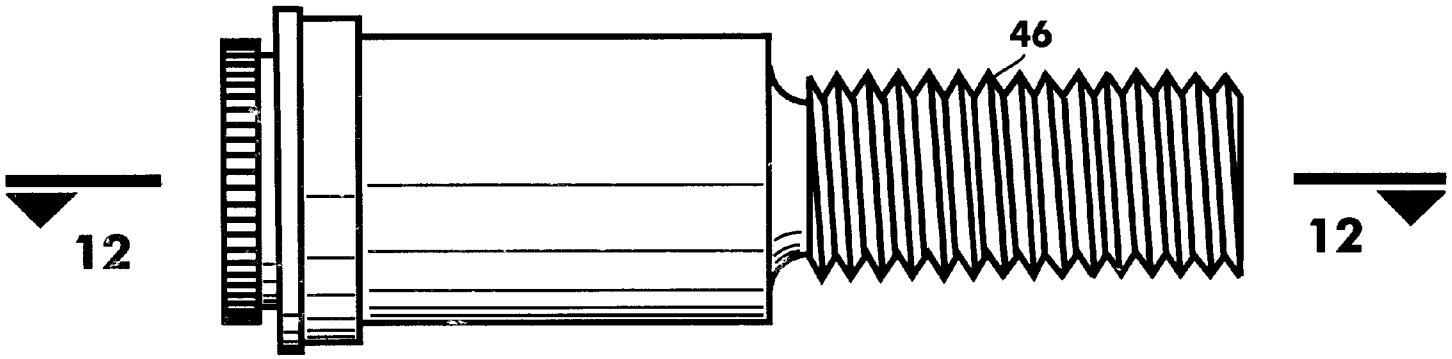
FIG. 11 is a side-elevational view of a connector shank which functions to interconnect the cooling component with a conventional dispensing faucet of the beverage dispensing system.
Figure 14:
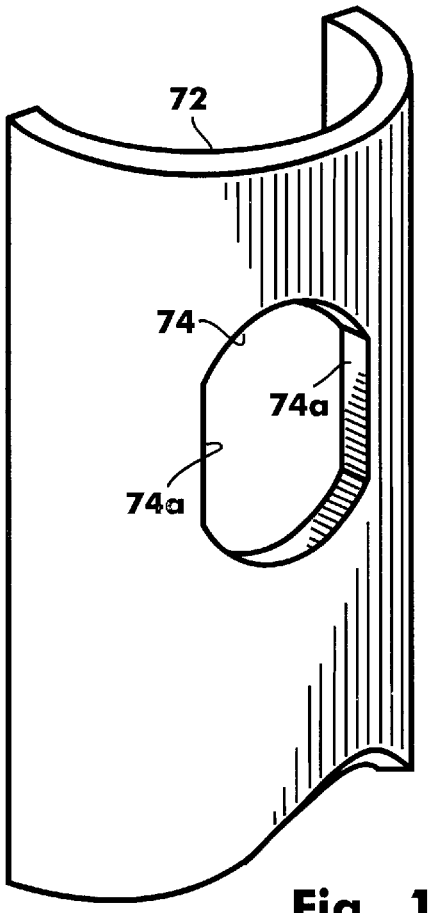
FIG. 14 is a generally perspective, fragmentary view of the tower insert component of the apparatus of the invention that is provided with a strategically shaped opening that lockably receives one end of the cooling component and prevents its rotation during the connection of the dispensing faucet with the cooling component.

When the cooling component of the invention is used with conventional draft tower, an internal sleeve of the general configuration shown in FIG. 14 is used. Sleeve 72 is closely received within the interior of the draft tower and is provided with a strategically formed opening 74 that includes a pair of oppositely disposed flats 74*a*. Flats 74*a* are engaged by a pair of oppositely disposed flats 76 formed on body portion 42*a* of the cooling component (FIG. 10). This highly unique feature of the cooling component prevents rotation of the cooling component within the draft tower during interconnection of the beverage dispensing faucet assembly with the draft tower and with the cooling component using the faucet connection means shown in FIGS. 11 and 12. More particularly, with this novel construction, when flats 76 of the cooling component 42 are received within opening 74 provided in sleeve 72, shank portion 46 of the faucet connector means can be threadably interconnected with internal bore 44 of the cooling component and, during this connection process, the cooling component and the connector tube affixed thereto will be locked against rotation relative to sleeve 72 and relative to the draft tower of the dispensing system. This novel and important feature is not found in the prior art.

Figure 6A:
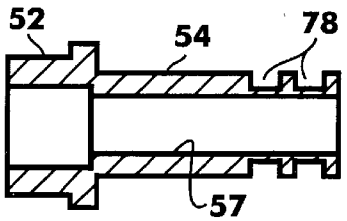
FIG. 6A is a side-elevational, cross-sectional view of a connector probe that is connected to one end of the connector tube of the apparatus as shown in FIGS. 5 and 6.

As best seen in FIG. 6A, connector probe 54 of the present form of the apparatus is provided with a pair of longitudinally spaced apart O-ring receiving grooves 78 which closely receive and retain therewithin a pair of elastomeric O-rings 79 of conventional construction (FIG. 6). With this construction, after the faucet connecting means has been suitably interconnected with internally threaded bore 44, O-rings 79 will engage the inner wall 80 of an axially extending bore 82 formed in the faucet connecting means (FIG. 12) and will prevent leakage of fluid between the connector probe 56 and the internal wall 80 of the faucet connecting means.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for use with a beverage dispensing system having a dispensing faucet, including a connector shank, a remote beverage container, a feed line connected to the beverage container and a cooling tube through which a refrigerant flows, the apparatus comprising an assembly for interconnecting the feed line with the faucet, said assembly comprising:

(a) a cooling component having:
  (i) a first threaded bore; and
  (ii) a cooling tube receiving groove circumscribing said first threaded bore; and (b) a connector probe connected to said cooling component and extending outwardly therefrom; and (c) a connector tube having a first end connected to said connector probe, a body portion extending through said first threaded bore of said cooling component and a second end connected to the feed line.

2. The apparatus as defined in claim 1 in which said cooling component further includes a first end portion provided with a pair of oppositely disposed flats.

3. The apparatus as defined in claim 1 in which said cooling component further includes a second reduced diameter bore coaxially aligned with said first threaded bore and in which said connector probe includes a connector portion closely received within said second bore.

4. The apparatus as defined in claim 1 further including connector means for connecting the faucet to said cooling component and in which said connector probe includes sealing means for sealably engaging said connector means.

5. The apparatus as defined in claim 1 in which said cooling component further includes a plurality of radially outwardly extending locking fingers for locking the cooling tube within said cooling tube receiving groove.

6. The apparatus as defined in claim 1 further including feed line connector means provided proximate said second end of said connector tube for connecting said connector tube to the feed line.

7. An apparatus for use with a beverage dispensing system having a dispensing faucet, a remote beverage container, a feed line connected to the beverage container and a cooling tube through which a refrigerant flows, the apparatus comprising an assembly for interconnecting the feed line with the faucet, said assembly comprising:

(a) a cooling component having a first end portion provided with a pair of oppositely disposed flats and further including:
  (i) a first threaded bore for receiving the connector shank of the faucet; and
  (ii) a second reduced diameter bore coaxially aligned with said first threaded bore;
  (iii) a cooling tube receiving groove circumscribing said first threaded bore; and
  (iv) a plurality of radially outwardly extending locking fingers for locking the cooling tube within said cooling tube receiving groove; and (b) a connector probe connected to said cooling component and extending outwardly therefrom; and (c) a connector tube having a first end connected to said connector probe, a body portion extending through said first threaded bore of said cooling component and a second end connected to the feed line.

8. The apparatus as defined in claim 7 further including feed line connector means provided proximate said second end of said connector tube for connecting said connector tube to the feed line.

9. The apparatus as defined in claim 7 in which said connector probe includes a shank portion and a connector portion, said connector portion being closely received with said second reduced diameter bore of said cooling component.

10. The apparatus as defined in claim 9 further including connector means for connecting the faucet with said cooling component and in which said connector probe includes sealing means provided on said shank portion for sealably engaging said means.

11. The apparatus as defined in claim 9 in which said sealing means comprises at least one elastomeric O-ring circumscribing said shank portion of said connector probe.

* * * * *